US009548579B2

(12) United States Patent
Lehmann et al.

(10) Patent No.: US 9,548,579 B2
(45) Date of Patent: Jan. 17, 2017

(54) METHOD FOR ASSEMBLING CABLES

(75) Inventors: Lutz Lehmann, Vilsbiburg (DE); Wolfgang Wimmer, Salching (DE); Stefan Wimmer, Hohenthann (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 202 days.

(21) Appl. No.: 14/128,300

(22) PCT Filed: Jun. 18, 2012

(86) PCT No.: PCT/EP2012/061565
§ 371 (c)(1),
(2), (4) Date: Dec. 20, 2013

(87) PCT Pub. No.: WO2012/175441
PCT Pub. Date: Dec. 27, 2012

(65) Prior Publication Data

US 2014/0150259 A1 Jun. 5, 2014

(30) Foreign Application Priority Data

Jun. 21, 2011 (DE) ..... 10 2011 077 889

(51) Int. Cl.
*H01R 43/01* (2006.01)
*H01R 4/20* (2006.01)
(Continued)

(52) U.S. Cl.
CPC ..... *H01R 43/01* (2013.01); *H01R 4/203* (2013.01); *H01R 4/2495* (2013.01);
(Continued)

(58) Field of Classification Search
CPC ..... H01R 43/01; H01R 43/0207; H01R 4/203; H01R 4/2495; H01R 13/5205; Y10T 29/49174
See application file for complete search history.

(56) References Cited

U.S. PATENT DOCUMENTS 4,607,778 A * 8/1986 Oakley ..... B23K 20/06 219/617
4,705,915 A 11/1987 Van Brunt et al.
(Continued)

FOREIGN PATENT DOCUMENTS

DE 10 2010 003 599 A1 10/2011
DE 201010003599 A1 10/2011
(Continued)

OTHER PUBLICATIONS

International Search Report of PCT/EP2012/061565 dated Sep. 4, 2012 (4 pages with translation).
(Continued)

*Primary Examiner* — Peter DungBa Vo
*Assistant Examiner* — Jeffrey T Carley
(74) *Attorney, Agent, or Firm* — Finnegan, Henderson, Farabow, Garrett & Dunner LLP

(57) ABSTRACT

A method for assembling cables includes sliding a housing and a sleeve accommodated in the housing onto a cable in such a manner that the sleeve surrounds at least a portion of the cable. The housing is made of an electrically non-conductive material, the sleeve is made of an electrically conductive material and includes a cutting edge pointing radially inward, and the cable includes a conducting element and an insulation surrounding the conducting element. The method further includes magnetically forming the sleeve by applying a magnetic field to the sleeve through the housing, such that the sleeve is pressed against the insulation and the cutting edge penetrates the insulation completely and contacts the conducting element.

8 Claims, 2 Drawing Sheets

Figure 1:
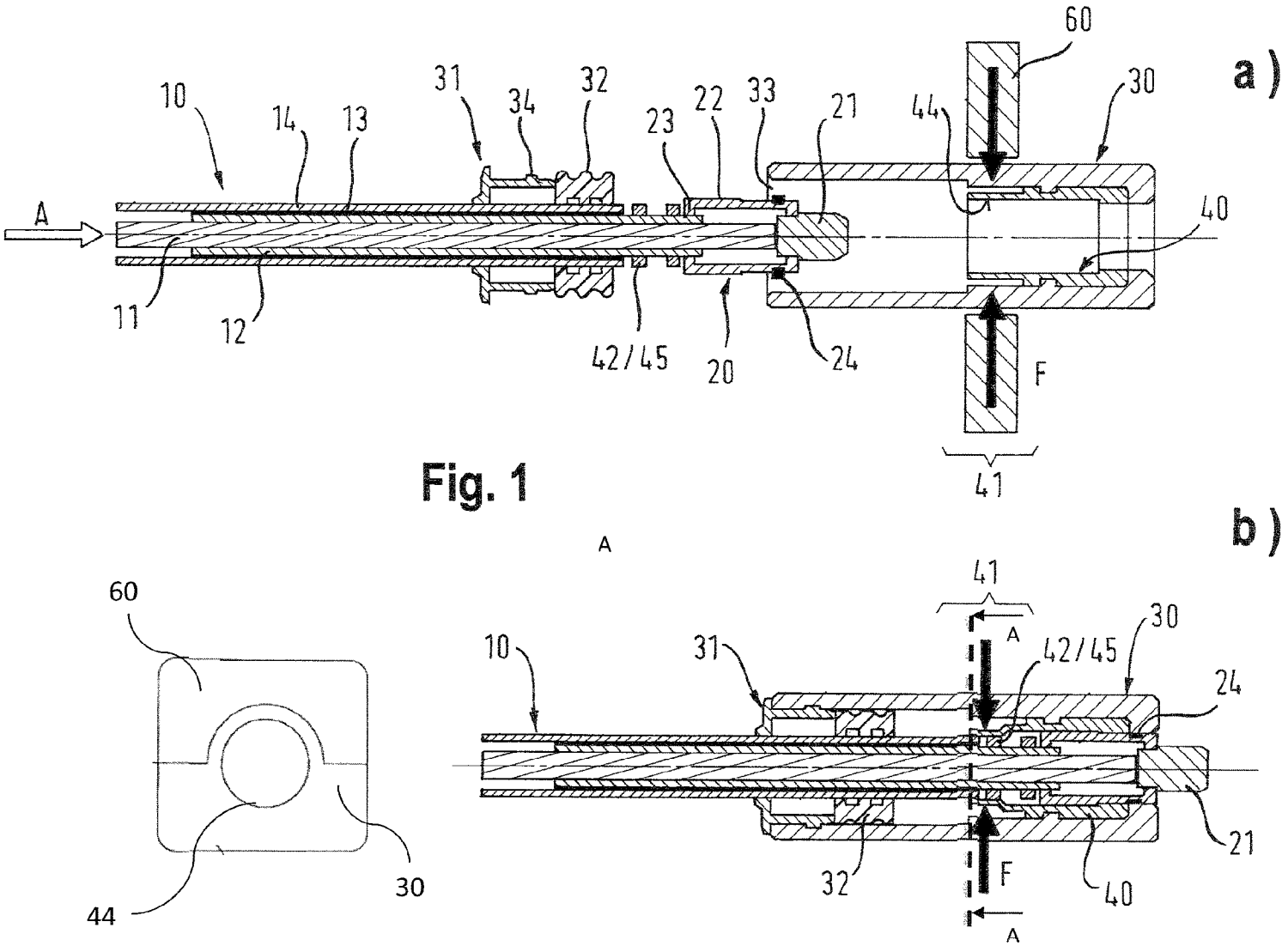

(51) Int. Cl.

| | |
|---|---|
| ***H01R 4/24*** | (2006.01) |
| ***H01R 43/02*** | (2006.01) |
| *H01R 13/52* | (2006.01) |

(52) U.S. Cl.
CPC ..... *H01R 43/0207* (2013.01); *H01R 13/5205* (2013.01); *Y10T 29/49174* (2015.01)

(56) References Cited

U.S. PATENT DOCUMENTS

| | | | | |
|---|---|---|---|---|
| 5,658,163 | A * | 8/1997 | DeRoss ..... | H01R 4/2495 174/84 C |
| 5,749,756 | A | 5/1998 | Vockroth et al. | |
| 2010/0258330 | A1* | 10/2010 | Sy ..... | H02G 15/013 174/50.52 |
| 2013/0199841 | A1 | 8/2013 | Lehmann et al. | |

FOREIGN PATENT DOCUMENTS

| | | | |
|---|---|---|---|
| FR | 2 605 812 | A1 | 4/1988 |
| WO | WO 97-22426 | A2 | 6/1997 |

OTHER PUBLICATIONS

Written Opinion of the International Searching Authority, issued by International Searching Authority, mailed Sep. 4, 2012, in international application No. PCT/EP2012/061565, and English translation of the Written Opinion (10 pages).

International Preliminary Report on Patentability, issued by the International Bureau of WIPO, mailed Dec. 23, 2013, in international application No. PCT/EP2012/061565, and English translation of the International Preliminary Report on Patentability (12 pages).

* cited by examiner

METHOD FOR ASSEMBLING CABLES

This is a U.S. National Phase of PCT/EP2012/061565, filed Jun. 18, 2012, which claims the benefit of priority to German Patent Application No. 10 2011 077 889.6, filed Jun. 21, 2011, the contents of both of which are incorporated herein by reference.

The present invention relates to a method for assembling cables, in particular for use in vehicles and motor vehicles.

Different methods are known from prior art regarding the attachment of contact elements, for example plug connectors. Usually a cable or the conductor thereof is brought toward a plug connector, and the housing of the plug housing is removed or opened during the connection of the conductor to the plug connector. Possible connection methods that can be considered are clamping, screwing, crimping, welding and/or soldering. Furthermore known from the subsequently published DE 10 2010 003 599 A is the use of a magnetic forming method for producing a positive-adhesive connection of a sleeve with the wire strands of a conductor. After connecting the contact element with the conductor end the connector housing is assembled for further use and/or closed.

In the case of these conventional connection methods the connections are established only individually or sequentially, and the housing has to be disassembled and assembled again, or to be opened and closed, with the result that the expenditure of time for the production is relatively high.

Solving this problem is the task of the present invention.

A method with the features of claim 1 achieves this aim. Advantageous embodiments of the present invention are specified in the dependent claims.

The present invention is based on the thought of preparing pre-assembled contact elements and placing stripped conductor ends in corresponding contact points of the contact elements, and surrounding them with a circumferentially closed housing. This is followed by a magnetic forming that takes place through the housing to establish contact between the conductor ends with the contact points of the contact elements, so that the disassembly, assembly or the opening and closing of the housing can be omitted, and additionally several connections can be established simultaneously between conductor ends and contact points.

Correspondingly the present invention defines a method for assembling cables. In the context of this method a housing made of electrically non-conductive material and a sleeve made of electrically conductive material that is or can be accommodated in the housing is slid onto a cable. In the process the sleeve can be slid on together with the housing or, separately, the sleeve can be slid on first, and the housing can be slid on subsequently. Of course, the sleeve can also be disposed in the housing, and an end of the cable can be introduced into the sleeve. The sliding-on process describes in this case only a relative movement of the cable to the housing. In the context not only the housing or the sleeve has to execute a movement, but instead the cable can also execute a movement. In any case the sleeve will surround the cable in the longitudinal direction at least in some sections, and the housing will surround the sleeve preferably at least in a section. According to the invention the sleeve is subsequently formed through a magnetic forming method through the application of a magnetic field to the sleeve through the housing. The magnetic forming is an electrodynamic high-energy forming method for the purpose of cold-forming electrically conductive materials by means of electromagnetic pulse technology (magnetic pulse; EMPT). In the process the semi-finished product, in this case the contact sleeve, is positioned within an inductor, if applicable with an interposed field shaper, and formed without contact by means of the force of a pulsed magnetic field of very high intensity, i.e., in contrast to crimping without mechanical contact with the tool. In the process a uniform and symmetric force distribution can be applied along the circumference of the contacting sleeve by means of the magnetic forming method, so that a uniform forming of the contact sleeve results along the circumference and the contact sleeve does not exhibit any mechanical strains on its outer surface. In this regard the sleeve is in particular completely enclosed in the area that is formed later by the magnetic field. The housing can, for example, be made of a plastic and the sleeve can be made of metal, for example aluminum. The housing can be, for example, the housing of a connector or a device. In reference to motor vehicles this can concern the so-called "E-box", for example, in which the control device(s) of the motor vehicle is (are) accommodated. Since the forming of the contact elements is achieved using a field shaper that is disposed outside the housing, the distance to the contact element should be kept as small as possible. The selection of a distance of at most 1 mm is advantageous in this case, in particular if no insulation is disposed between the field shaper and the contact element. Furthermore preferred is that the field shaper is matched to the outer wall of the housing, and that the housing is matched to the form of the contact element. For example, the housing can comprise recesses for the field former. Alternatively it is also conceivable to equip the housing with an area that serves as a field shaper during the magnetic forming. This means that the housing and the field shaper are integrally formed, for example, by a coating or an inlay. Using the embodiment according to the invention it is conceivable to have a contact element come into contact, pre-assembled, with an open conducting element, and to implement the attachment of the contact element to the conducting element via the forming of the sleeve. The housing can be, for example, a wall or an enclosure of a cable grommet, a connector, a device and/or a component group.

Simultaneously the sleeve is used for establishing contact with the shielding of a coaxial cable. In this regard the sleeve has advantageously a cutting edge that points radially inward and said sleeve is slid around a cable with an externally lying insulation, a protective jacket and a conductive element that is surrounded by the insulation, in particular a shielding. During the magnetic forming of the sleeve said magnetic forming takes place in the area of the cutting edge, so that the cutting edge penetrates the insulation completely when the sleeve is pressed onto the insulation and at least contacts the conducting element, in particular the shielding, preferably penetrating partially into the conducting element. The latter produces a reliable contact. Furthermore it is possible to apply a symmetric force to the sleeve via the magnetic forming method, so that a defined penetration by the cutting edge can be implemented without damaging the shielding or the layers lying below said shielding. Since this can be accomplished through the housing in the case of a sleeve that is pre-assembled in the housing, a completely assembled cable end can be implemented without attendant assembly steps being necessary. Furthermore a support element or a support pin can be disposed on the cable in order to thereby counteract a penetration of the sleeve that is too deep, or to cause the conducting element to be welded to the sleeve and/or the support pin.

For example, the housing can be placed at ground potential with the method according to the invention when contact of the sleeve with a ground conductor of the cable is established, so that, for example, a component group surrounded by the housing is shielded. For that purpose the housing should be manufactured from electrically conducting material.

Furthermore it is also conceivable to implement a longitudinal watertight seal in the housing with respect to the junction within the housing itself. For that purpose it can be advantageous to dispose at least one sealing element on the inner side of the sleeve or the outer side of the cable, and to press the sealing element that is disposed between the sleeve and the conductor against the outer side of the cable during the magnetic forming in order to establish a sealing contact between the outer side of the cable and the inner side of the sleeve. This can involve a separate sealing element, for example a sealing ring or a coating made of sealing material. By pressing the sleeve against the insulation during the magnetic forming, for example, the sealing element is pressed into a sealing contact with the insulation and seals along the circumference as a result, so that water entry can be avoided by straightforward ways and means, without additional process steps being required.

This procedure is in particular preferred in the case of a wire that has a conducting element, in particular a wire strand or a shielding as well as an insulation that encloses the conducting element, wherein the sealing element is pressed against the outer side of the insulation during the magnetic forming in order to establish a sealing contact with the outer side of the insulation. This can involve, in the case of a coaxial cable, either the outer insulation, which encloses the shielding, or the inner insulation, which encloses the conductor or the core.

Preference can furthermore be given to the attachment of the sleeve within the housing, to attach the housing to the cable directly or merely via the connection of the sleeve with the cable through the magnetic forming. For example, anchoring elements could be provided for this purpose on the inner side of the sleeve that penetrate partially into the protective jacket or insulation of the cable during the magnetic forming, and thereby implement an anchoring of the sleeve and therefore of the housing in the longitudinal direction of the cable.

Figure 2:
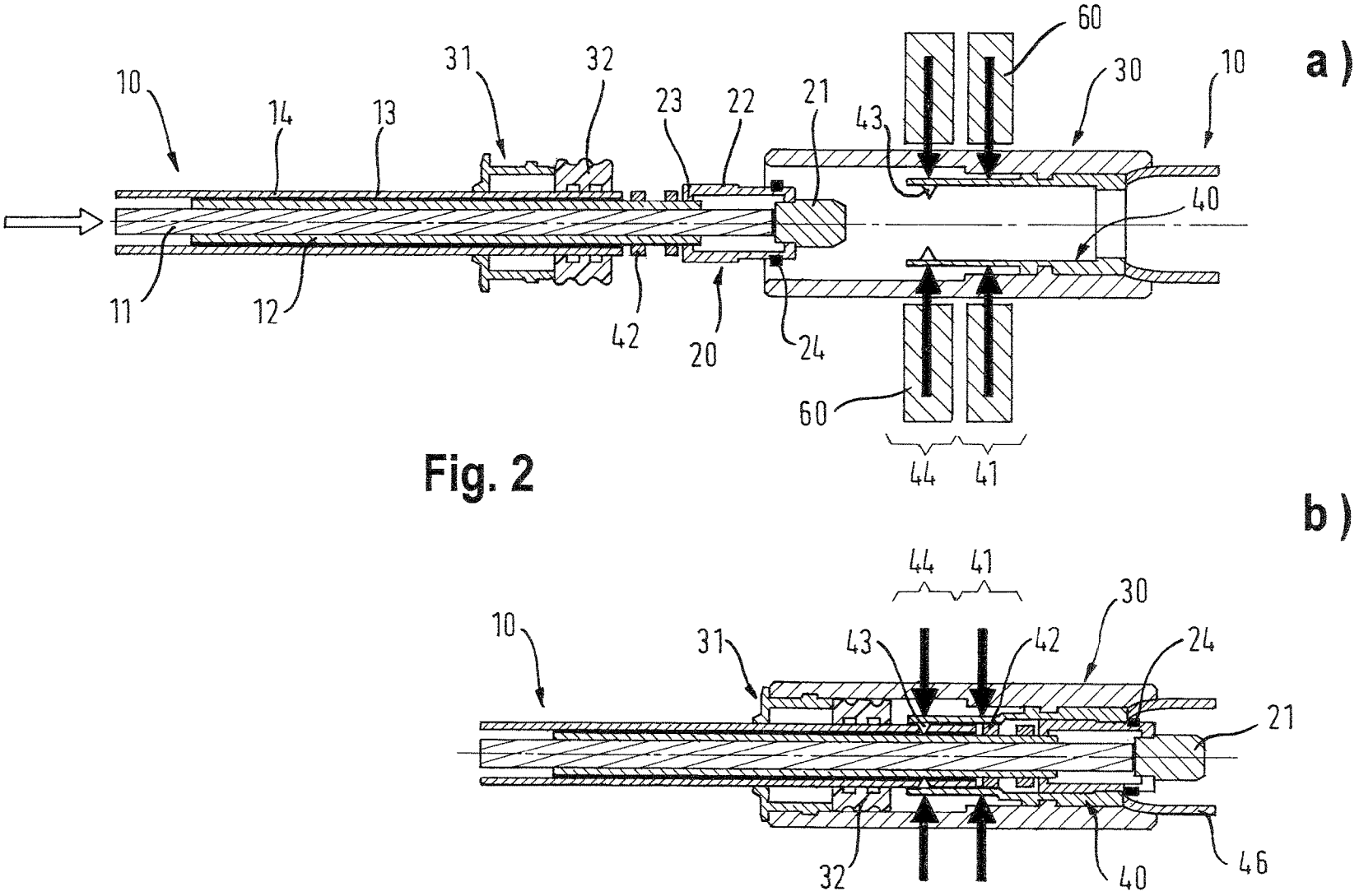

Additional advantages and features of the present invention that can be implemented individually or in combination with one or several of the above features, to the extent that they are not mutually contradictory, are found in the following description of preferred embodiments of the present invention. Said description is given in reference to the accompanying drawings in which:

FIG. 1*a* shows a method for assembling a wire according to a first embodiment of the present invention, prior to the sliding-on of a housing with a sleeve accommodated therein;

FIG. 1*b* shows the wire from FIG. 1*a* after the assembly and, on the left hand, a schematic cross section along the line A-A with the field shaper still positioned;

FIG. 2*a* shows a method for assembling a wire according to a second embodiment of the present invention, prior to the sliding-on of a housing with a sleeve accommodated therein; and FIG. 2*b* shows the wire from FIG. 2 after the assembly.

In the drawings identical reference symbols identify identical or comparable elements. Furthermore repeated descriptions of these elements are usually omitted. It is however understood that the description of an element of an embodiment applies similarly also to the description of the element or a comparable element in another embodiment, to the extent that this does not give rise to contradictions.

FIG. 1 displays a cable 10 that concerns a coaxial cable. Said coaxial cable has a conductor or a core 11 that is surrounded by an inner insulation 12 or a dielectric. Furthermore a protective jacket 14 or an outer insulation is provided, between which outer insulation and the inner insulation 12 a shielding is provided in the form of a metal braiding 13.

The cable is stripped at one end, so that the conductor 11 is open on this end. Likewise a part of the shielding 13 and the outer insulation 14 is removed from the section adjacent to the open part.

At the end of the cable 10 a contact element 20 in the shape of a pin 21 is contacted. In the process the pin 21 is held in contact with the conductor 11 by means of the anchoring 22. In the process the anchoring 22 engages the insulation 12 lying on the inner side with engagement elements 23 in order to hold the pin 21 in contact with the conductor 11. Moreover a sealing ring 24 is provided in the anchoring 22.

Furthermore a housing lid 31 as well as a sealing 32 are slid onto the cable 10, the outer insulation 14 or the protective jacket in an enclosing manner. The cable that is pre-assembled in this manner is slid into a housing 30 with a substantially cylindrical base form in the direction of the arrow A. In the process the sealing 32 and the housing lid 31 are slid into the open end 33 of the housing 30, and the lid 31 is locked in the housing by known ways and means, for which purpose the lid is designed with corresponding snap-in connections 34. As a result of the sliding-in, the outer side of the sealing 32 as well as the outer side of the sealing 24 comes in contact with an inner side of the housing 30, so that here a sealing off against longitudinal water entry can be implemented on both housing ends.

Subsequently a field shaper 60 of a magnetic forming device is positioned around the housing 30, surrounding said housing. As schematically displayed in FIG. 1 *b* on the left hand side, the housing 30 and the field shaper 60 are matched to each other regarding their contour. The housing 30 has, on the side facing the field shaper 60, a bulge that matches the contour of the sleeve 44, while the field shaper 60 has a corresponding recess. As a result the distance between the field shaper and the sleeve can be kept small. The field shaper 60 generates a magnetic field in the area 41. Said magnetic field is applied through the housing 30 to the sleeve 40 that is attached in the housing 30, said sleeve being thereby plastically deformed in the area 41. During this deformation the inner side 44 of the sleeve 40 comes into contact with the outer side of the sealing ring 42, and presses said sealing ring against the insulation 12 lying on the inner side, in order to implement an additional seal here. Subsequently the completely assembled cable end can be removed from the magnetic forming device, without attendant steps being required.

Alternatively it is also conceivable to provide, instead of the sealing 42, a contact ring that does not abut the insulation 12 lying on the inner side, but instead contacts or is in contact with the shielding 13. In this case making contact with the sleeve 40 as a result of the magnetic forming in the area 41 can be implemented via a connection with the contacting element 42 or via mere abutment as well as pressing of the contacting elements 42 against the outer surface of the shielding. In this case it is also conceivable that the sleeve 40 forms a part of a coaxial connector.

This principle is also implemented in the embodiment in FIG. 2, wherein in this respect only the differences to the embodiment in FIG. 1 are addressed.

In particular the sleeve 40 in FIG. 2 continues on in the longitudinal direction of the cable to a contact area 44. In this contact area 44 the sleeve 40 surrounds the outer insulation 14 of the cable 10, as is apparent from FIG. 2*b*. Furthermore a cutting edge 43 is provided on the radially internal side of the sleeve 40 in this contact area 44. Moreover the sleeve 40 extends, on the side of the housing facing the pin 21 and insulated from the pin 21, through the housing toward the exterior and surrounds the pin 21 coaxially. This part 46 of the sleeve forms a part of the coaxial connector lying coaxially on the outside, while pin 21 forms the part of the connector lying coaxially on the inside.

Two separate field shapers 60 or one common one can be used during the magnetic forming. In the process a magnetic field is preferably applied simultaneously (but a separate process step is also conceivable) through the housing 30 to the sleeve 40 in the areas 41 and 44, wherein a plastic deformation of the sleeve 40 takes place in these areas due to a force F. A sealing takes place in the process, as explained in reference to FIG. 1, between the inner side of the sleeve and the outer side of the insulation 11 lying on the interior via the sealing element 42.

In the area 44 the sleeve 40 is furthermore pressed against the insulation 14 lying on the outside. In the process the cutting edge 43 penetrates the insulation 14 lying on the outside completely, and contacts the shielding 13. If applicable, said cutting edge can also penetrate partially into the shielding 13 to assure a reliable contact.

In this case it is conceivable that the anchoring 22 of the pin 21 between the sleeve 40 and the pin 21 has an insulating effect, i.e. is formed of electrically non-conducting material. Alternatively it is also conceivable to provide at least in some areas an electrical insulation on the radially internal side of the sleeve 40.

It is understood that the present invention has been explained on the basis of the exemplary embodiments, the invention is however not limited to these embodiments. Rather it is also conceivable in FIG. 2 to omit the sealing 42 and to perform a forming merely in the contact area 44. It is also conceivable to provide an additional forming area, for example in the area of the anchoring 22 of the pin 21, so that the anchoring 22 is pressed in the direction of the insulation 12 lying on the inside by the forming of the sleeve 40, so that the anchorings 23 penetrate this insulation to a minor extent. Consequently a prior crimping step of the anchoring 22 on the conductor end can be omitted, if applicable. As a result the efficiency of the method is further increased.

Basically it is also possible to provide one or also several sleeves 40 for a housing 30 or to arrange said sleeve(s) in the housing 30, which sleeves establish a contact with the cable 10. With a corresponding design of one or several magnetic formers a magnetic field can be applied simultaneously through the sleeves 40 to several connections or contacts, so that several cables or a set of wires, disposed at one or several housing(s) 30, can be contacted and/or processed. For that purpose several conductors can, for example, be arranged next to each other in a housing.

In particular if the magnetic field is to be applied to several positions or components, this can take place simultaneously, sequentially or in an otherwise defined sequence, so that for example first a contact of the conductor 11 is established with the pin 21, and then a contact of the shielding 13 with the sleeve 40 and, if necessary, with the housing 30.

The invention claimed is:

1. A method for assembling cables comprising:

sliding a housing and a sleeve accommodated in the housing onto a cable in such a manner that the sleeve surrounds at least a portion of the cable, wherein:

the housing is made of an electrically non-conductive material, the sleeve is made of an electrically conductive material and includes a first portion and a second portion, the first portion including a cutting edge pointing radially inward, and the cable includes:

a conducting element; and an insulation surrounding the conducting element; and magnetically forming the sleeve by applying a magnetic field to the sleeve through the housing to plastically deform the first portion of the sleeve without deforming the second portion of the sleeve, wherein magnetically forming the sleeve includes plastically deforming the first portion of the sleeve without deforming the housing, such that the sleeve is pressed against the insulation and the cutting edge penetrates the insulation completely and contacts the conducting element.

2. The method according to claim 1, wherein magnetically forming the sleeve includes magnetically forming the sleeve such that the cutting edge penetrates partially into the conducting element.

3. The method according to claim 1, wherein magnetically forming the sleeve includes magnetically forming the sleeve such that a sealing element disposed on an inner side of the sleeve is pressed against an outer side of the cable to establish a sealing contact with the outer side of the cable.

4. The method according to claim 3, wherein magnetically forming the sleeve includes magnetically forming the sleeve such that the sealing element is pressed against an outer side of the insulation to establish a sealing contact with the outer side of the insulation.

5. The method according to claim 1, wherein magnetically forming the sleeve includes magnetically forming the sleeve such that the housing is connected to the cable via the sleeve.

6. The method according to claim 1, wherein:

applying the magnetic field to the sleeve includes applying a magnetic field using a field shaper disposed outside the housing, and the housing includes a bulge on a side of the housing that faces the field shaper, the bulge matching a contour of the sleeve.

7. The method according to claim 1, wherein the first portion has been plastically deformed to a first outer dimension and wherein the second portion has a second outer dimension that is greater than the first outer dimension.

8. The method according to claim 1, wherein:

sliding the housing and the sleeve onto the cable includes sliding the housing and the sleeve onto the cable such that one end of the cable slides along a longitudinal direction of the sleeve into the sleeve from a first side of the sleeve and out of the sleeve from a second side of the sleeve, the first portion of the sleeve is closer to the first end of the sleeve than the second portion of the sleeve, and the second portion of the sleeve is closer to the second end of the sleeve than the first portion of the sleeve.

* * * * *